United States Patent [19]

Oda

[11] Patent Number: 4,747,923

[45] Date of Patent: May 31, 1988

[54] DEVICE FOR PERFORMING CONTINUOUS ELECTROLYTIC TREATMENT ON A METAL WEB

[75] Inventor: Kazutaka Oda, Shizuoka, Japan

[73] Assignee: Fuji Photo Film Co., Ltd., Kanagawa, Japan

[21] Appl. No.: 939,839

[22] Filed: Dec. 9, 1986

[30] Foreign Application Priority Data

Dec. 9, 1985 [JP] Japan ..... 60-275027

[51] Int. Cl.[4] ..... C25D 17/00

[52] U.S. Cl. ..... 204/206

[58] Field of Search ..... 204/206, 211

[56] References Cited

U.S. PATENT DOCUMENTS 4,007,097 2/1977 Noz ..... 204/224 R

FOREIGN PATENT DOCUMENTS 1014528 8/1952 France ..... 204/224 R
7433442 5/1975 France ..... 204/224 R
608557 9/1948 United Kingdom ..... 204/DIG. 7

*Primary Examiner*—T. M. Tufariello
*Attorney, Agent, or Firm*—Sughrue, Mion, Zinn, Macpeak & Seas

[57] ABSTRACT

A cylindrical electrolytic treatment vessel, containing an electrolyte and serving as one electrode, rotatably mounts in a concentric manner a cylindrical rotary body which is mounted for rotation horizontally about its axis. The cylindrical rotary body has enlarged diameter portions at opposite axial ends and at least the peripheral surfaces of the enlarged diameter portions are made of an electrically insolative material. The rotor body has a central smaller diameter portion intermediate of the enlarged diameter portions which is formed of metal and constitutes a second electrode. Electricity is applied between the treatment vessel and the cylindrical rotor body electrode. The metal web is rotatably supported along opposed side edge portions of the web by the electrically insulative surfaces of the enlarged diameter portions of the body so that continuous electrolytic treatment is effected to the metal web as it passes through the electrolyte.

3 Claims, 2 Drawing Sheets

DEVICE FOR PERFORMING CONTINUOUS ELECTROLYTIC TREATMENT ON A METAL WEB

FIELD OF THE INVENTION

This invention relates to a device for performing continuous electrolytic treatment on a metal web and particularly to a high efficiency electrolytic treatment vessel in which a heavy electrical current may be stably supplied, and in which the electrolytic treatment of the metal web is characterized by both uniformity and stability of the electrolytic reaction.

DESCRIPTION OF THE PRIOR ART

The application of electrolysis to a surface of a metal such as iron and aluminum includes plating, surface roughening, etching, and anodic oxidation, coloring and the like, and is widely put to practical use. The requirement for higher uniformity and stability of the above-mentioned surface treatment of the metal and for reduction in electrical power consumption is a constant concern from an industrial viewpoint.

Methods of performing continuous electrolytic treatment on a metal web are broadly divided into two groups, one of which includes the direct electricity supply method and the other of which includes the liquid electricity supply method.

Although the direct electricity supply method has the advantage that the Joule heat loss in a normal electricity supply section can be made smaller than that using the liquid electricity supply method, the direct electricity supply method has the problem of instability in the supply of heavy electrical current. In the direct electricity supply method, electricity is supplied normally by pinching or laying the metal web on conductive rollers made of copper, titanium, tantalum, platinum, niobium, aluminum, stainless steel, graphite or the like. However, problems occur such as an increase in electrical resistance and the occurrence of arc spots which are caused due to the change in the surface of each of the conductive rollers. To cope with such problems, a method of cleaning the surface of each conductor roller has evolved as disclosed in Japanese Laid-open Patent No. 59-41517. Furthermore, attempts have been made to improve the quality of the conductive rollers as disclosed in Japanese Laid-open Patent No. 58-177441. However, the instability in supply of heavy electrical current, which is the greatest disadvantage of the direct electricity supply method, has not been eliminated. Since the conductive rollers are located upstream and downstream relative to a treatment reaction vessel in terms of the direction of movement of the metal web in the ordinary sense, there is another disadvantage that a Joule heat loss is caused in the metal web during its movement between the upstream conductive roller and the treatment reaction vessel.

On the other hand, the liquid electricity supply method is characterized by a very high stability in the supply of heavy electrical current. However, since the electricity is supplied from an electricity supply electrode to the metal web through an electrolyte in an electricity supply section, a Joule heat loss is caused in that section. In the liquid electricity supply method, as exemplified by the apparatus indicated generally at 30 in FIG. 3, the electricity supply section 32 and reaction section 33 are usually horizontally juxtaposed. In such a case, an electric power loss is caused due to the Joule heat loss in the metal web 31 which moves in the direction of the arrow from left to right over large diameter rollers 34 and between a pair of rollers 35 within a tank or vessel 37, and with electrical power supplied from source 36 through electrodes 37, 38. If the metal web is a foil, the electric power loss is larger and the web is likely to be distorted due to the Joule heat generated therein.

To cope with such a problem, it is possible to cool the metal web in the manner disclosed in Japanese Laid-open Patent No. 60-67698. By experimental analysis it can be shown that the density of an electrical current flowing through the cross section of the metal web is 100 A/mm$^2$ or less for a high-conductivity material such as aluminum. For this reason, if a heavier electrical current is required, a plurality of electricity supply sections need to be provided to perform a division in the electrical supply so as to hold down the density of the electrical current flowing through the cross section of the metal web 31. As a means of solving these problems, attempts have been made to form a device such as that indicated generally at 40 in FIGS. 4 and 5 as disclosed in Japanese Patent Publication No. 58-24517, the device being of the liquid surface electricity supply type. In the device 40, an electricity supply section electrode 42 is positioned in parallel and spaced from a reaction section electrode 43, the electrodes face each other and a metal web 41 is moved through and between these electrodes, passing over and about rollers 48.

The leakage current between the facing electrodes 43, 44 in the device 40 creates a problem. To cope with this problem, a blocking mechanism such as that shown at 45 is required to electrically insulate the facing electrodes 43, 44 from each other to the outside of the metal web 41. If the width of the metal web 41 varies, the blocking mechanism 45 is required to adjust to the variation in the width of the web. In that case, the blocking mechanism cannot avoid being complicated. As of now, such blocking mechanism cannot be expected to produce enough blocking effect.

It is an object of the present invention to provide a high efficiency continuously electrolytic treatment device which not only includes the features of the liquid surface electricity supply type devices described above, wherein the stability in the supply of heavy electric current is high and the Joule heat loss is low, but a device which solves the problem of leakage current.

SUMMARY OF THE INVENTION

The invention is directed to a high-efficiency continuous electrolytic treatment device in which a cylindrical rotary body having enlarged diameter portions at both axial ends is disposed in a treatment vessel which contains an electrolyte and which vessel serves as one electrode. Further, at least the peripheral surfaces of the enlarged diameter portions of the cylindrical rotary body are formed of an electrical insulative material. A metal web is rotatively supported at respective side edge portions thereof in the electrolyte by the enlarged diameter portions of the rotary body. The metal web is continuously electrolytically treated by applying electricity between the treatment vessel and a second electrode which is constituted by the smaller diameter portion of the rotary body intermediate of the axial enlarged diameter end portions.

It is preferable that the transverse width of each of both of the side edge portions of the metal web which are supported by the rotary body are on the order of 10 to 50 mm depending upon the minimum width of the web. The distance between the metal web and the electrode which constitutes the small diameter portion of the rotary body is set at about 5 to 30 mm. Is also effective to make the electrical insulative material surface of each of the enlarged diameter portions of the rotary body, elastic.

As a result thereof, in accordance with the present invention, the cylindrical rotary body, which has at both of its axial ends, enlarged diameter portions which support the metal web at respective side edges thereof to continuously convey the web, is dipped in the treatment vessel which serves as one electrode. The treatment vessel and the other electrode constituted by the small diameter portion of the cylindrical rotary body intermediate of the enlarged diameter portion, are electrically insulated from each other by the peripheral surfaces of the large diameter portions of the rotary body so that the liquid surface electricity supplying action is performed through the reverse side of the metal web. Both of the electrodes are located as close to the metal web as possible. As a result, a heavy electrical current can be stably supplied while the Joule heat loss is held down. Since the electrical insulative material constituting the peripheral surface of each of the enlarged diameter potions of the cylindrical rotary body supports the metal web at both side edge portions thereof, the leakage current can be effectively blocked.

DESCRIPTION OF THE PREFERRED EMBODIMENT

Figure 1:
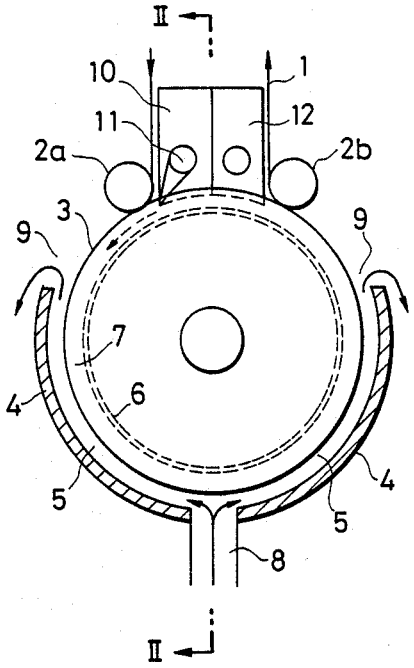
FIG. 1 is a schematic view of a metal web continuous electrolytic treatment device forming a preferred embodiment of the present invention.
Figure 2:
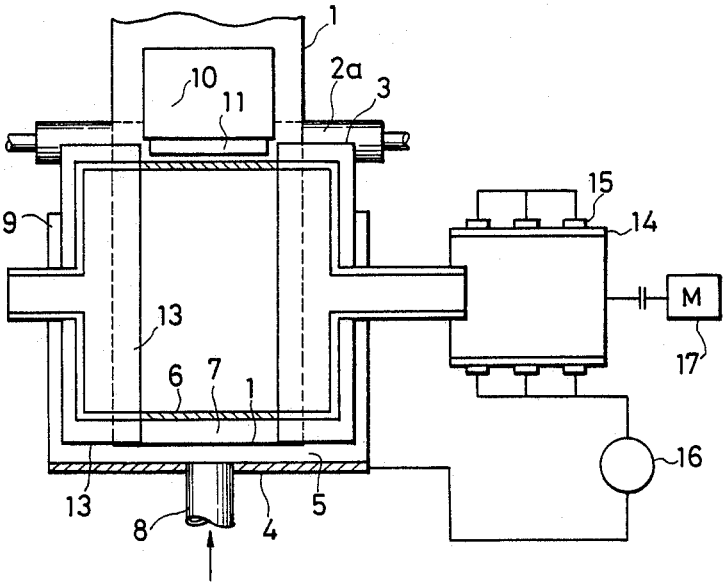
FIG. 2 is a sectional view of the device of FIG. 1 taken along line II—II.
Figure 3:
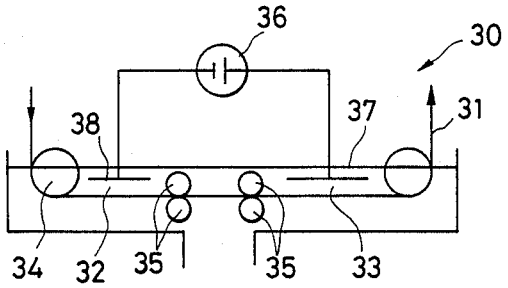
FIG. 3 PRIOR ART
FIG. 3 is a schematic view of a conventional electrolyzer of the liquid electricity supply type.
Figure 4:
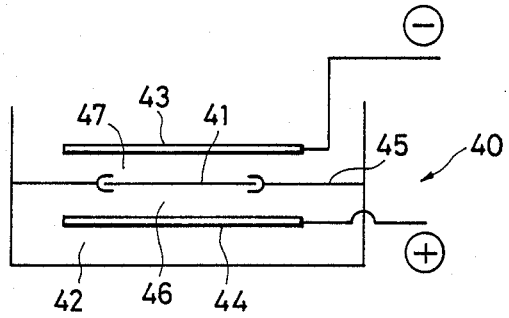
FIG. 4 PRIOR ART
FIGS. 4 and 5 are a schematic end view and side elevation view respectively of a conventional electrolyzer of the liquid surface electricity supply type.
Figure 5:
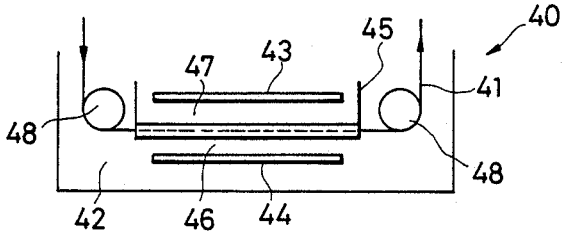
FIG. 5 PRIOR ART

Reference to FIGS. 1 and 2 illustrates a continuous electrolytic treatment device forming a preferred embodiment of the present invention. A metal web 1 is supported for movement on the periphery of a cylindrical rotary body 3 guided by pass rollers *2a, 2b* made of rubber to permit the metal web 1 to be introduced into a first electrolyte 5 which is contained in a treatment vessel 4 within which the cylindrical rotary body 3 is mounted for rotation. A motor 17 drives the cylindrical rotary body 3 in rotation about a horizontal axis. The treatment vessel 4 serves as one electrode and the vessel is concentric to the cylindrical rotary body 3 and faces the metal web 1. The distances between the metal web 1 and the electrode 4 is normally set at 5 to 30 mm. If the electric power loss in the device is to be reduced, the distance should be made as small as possible. If the treatment of the metal web 1 by the device is to be uniform, the gas produced as a result of the reaction in the treatment should be removed. The density of the electrical current for effecting the treatment, the flow velocity of the electrolyte in the reaction section of the device, the distance between the electrodes at the reaction section, and so forth should be set so as to insure that the treatment is uniform.

The electrolyte 5 is supplied to the treatment vessel 4 through an electrolyte feed port 8 provided at the bottom of the vessel. The electrolyte 5 is caused to flow counter to the movement of the metal web 1 as the metal web 1 moves downwardly and to the left about the periphery of the cylindrical rotary body 3, FIG. 1. This electrolyte is returned to a circulation tank (not shown) through electrolyte drain ports 9 provided at the open top of the treatment vessel 4. The system for circulating the electrolyte 5 through the treatment vessel 4 and the circulation tank is normally provided with a replenishing line for controlling the concentration of the electrode, a heat exchanger for controlling the temperature thereof, and a filter (all not shown).

An electrode 6 at the electricity supply section is built into the smaller diameter center portion of the cylindrical rotary body 3 so that the electrode 6 extends concentric to the rotary body and faces the metal web 1 across a distance of 5 to 20 mm. The width of the electrode 6 is made smaller than the width of the metal web 1. The width of the electrode 6 is normally between 20 to 100 mm smaller than the minimum width of the web 1 supported on the cylindrical rotary body 3. The cylindrical rotary body 3 is provided with enlarged diameter portions 13 at opposite ends thereof, with at least the surface of the enlarged diameter portions being made of an electrically insulative material and are positioned next to the electrode 6. The enlarged diameter portions 13 may be made of rubber such as neoprene and in tight surface contact with both the side edge portions of the metal web 1 so as to seal off the first electrolyte 5 on the exterior of the web 1 from the portion of a second electrolyte 7, internally of the web. The width of the tight contact of each enlarged diameter surface portion 13 with the corresponding side edge portion of the metal web is about 10 to 50 mm. Since the electrolytes 5 and 7 are completely separated from each other, the leakage current between the electrodes 4 and 6 is negligible. The electrode 6 is built into the cylindrical rotary body 3 which dips into the electrolyte 7 at the electricity supply section is connected to a slip ring 14 of an electricity feeder provided in an electrically-insulated state outside of the electrolyte 5. Electricity is supplied from a power source 16 to the electrode 6 via a series of brushes 15.

If the metal web 1, movably supported at both its side edge portions thereof on the enlarged diameter surface portions 13, is a foil, additional support portions made of an electrical insulator may be provided between the right and left radially enlarged cylindrical portions of the rotary body 3 in order, not only to support the side edge portions of the web but also to stably convey the web 1 without hindering the flow of electrolyte and causing the web to undergo wrinkling, sagging or the like.

The second electrolyte 7 for the electricity supply section is fed from the apparatus into a feed box 10 which is mounted over the cylindrical rotary body 3 and is then ejected into the inlet portion of the electricity supply section through feed nozzle 11. As a result of discharge from the feed nozzle 11, the electrolyte 7 is caused to flow in the same direction as the movement of the metal web 1 and passes through the electric supply section. The electrolyte 7 is thereafter returned to a circulation tank (not shown) through an electrolyte drain box 12 at the top of the apparatus and laterally adjacent to the feed box 10. The system for circulating the electrolyte 7 for the electricity supply section is normally provided with means (not shown) for effecting temperature control, concentration control, etc. as is true also for the circulation system for the other first electrolyte 5. The circulation system for the first electrolyte 5 and that for the second electrolyte 7 may be jointly provided with an electrolyte tank, a pump and control means under certain circumstances.

The electrodes 4 and 6 are connected to the anode and cathode of the power source 16. To perform a plating treatment on a steel sheet, the electrode 4 is connected to the anode and the other electrode 6 is connected to the cathode. To perform an anodic oxidation treatment on an aluminum sheet, the electrode 4 is connected to the cathode and the other electrode 6 is connected to the anode. The power source 16 is not necessarily a DC power source, but may be an AC power source or a superposed AC and DC power source for a desired surface treatment.

The device illustrated in FIGS. 1 and 2 has a number of positive effects which are as follows:

(1) Since an electrode for an electricity supply section is built into the small diameter portion of the cylindrical rotary body which dips into an electrolyte and the liquid surface electricity supply is performed through the reverse side of a metal web, a heavy electrical current may be stably supplied while the Joule heat loss is held down.

(2) Since the width of the electrode of the electricity supply section is made smaller than that of the metal web, at least the surfaces of the enlarged diameter portions of the cylindrical rotary body are made of an elastic electric insulator such as rubber, located axially outside of the electrode, the metal web is tightly overlaid on the elastic rubber electric insulator, and the electrode for the electricity supply section and a treatment vessel electrode are electrically connected to each other substantially only through the metal web, the result of which is that the leakage current is minimized so that the electric current efficiency is enhanced.

(3) Since the feed box and drain box for the electrolyte for the electricity supply section are positioned over the cylindrical rotary body, the electrolyte for the electricity supply section and that for the treatment reaction section are substantially separated from each other so that the leakage current is minimized.

(4) Since the surface of the enlarged diameter portions of the cylindrical rotary body are located in tight contact with the metal web and are formed of an elastic material such as rubber, the metal web is stably conveyed so that it is stable when treated, without undergoing scratching.

(5) Since the metal web is stably supported by the cylindrical rotary body, the distance between the metal web and each of the electrodes for the electricity supply section and for the treatment reaction section may be maintained accurate. Therefore, the present invention may be applied to an accurate treatment such as an electrolytic roughening treatment. Furthermore, the distance between the electrodes may be set to be small enough to reduce the electric power loss resulting from the generation of Joule heat.

(6) Since the device provided, according to the present invention, is of the liquid surface electricity supply type, substantially no electric power loss results from the generation of Joule heat which would be caused by the flow of electrical current in the metal web in the longitudinal direction thereof.

What is claimed is:

1. A device for performing continuous electrolytic treatment on a metal web, said device comprising:

(a) a treatment vessel containing a first electrolyte and serving as one electrode;

(b) a cylindrical rotary body mounted for rotation within the treatment vessel and having enlarged diameter portions at opposite axial ends thereof;

(c) at least the peripheral surfaces of said enlarged diameter portions being made of elastic, electrically insulative shoulder portions, said cylindrical rotary body having a central smaller diameter portion intermediate said enlarged diameter shoulder portions, said smaller diameter portion being formed of metal and constituting a second electrode;

(d) means for rotatably supporting a travelling metal web at edges of one side thereof using said electrically insulative elastic shoulders, a second electrolyte enclosed between said second electrode and said metal web and being sealed within said enclosure via the contact between said metal web and said elastic insulating shoulders, and means for applying an electrical potential across said treatment vessel and said second electrode, so as to perform continuous electrolytic treatment on a second side of said metal web as it passes through contact with said first and second electrolytes.

2. The device as claimed in claim 1, wherein said elastic material is rubber.

3. The device as claimed in claim 1, wherein said treatment vessel comprises a semicylindrical body closed at opposite ends and upwardly open, said semicylindrical body concentrically positioning said cylindrical rotary body thereon, an electrolyte supply port opening within the bottom of said semicylindrical body, said electrolyte supply port supplying said first electrolyte to the interior of said treatment vessel for contact with the outer periphery of said metal web borne by said cylindrical rotary body, a feed box and a drain box for supplying said removing, respectively, said second electrolyte, said feed box and said drain box being positioned above said cylindrical rotary body and in close proximity to the periphery of the central, smaller diameter portion of said rotary body, nozzle means carried by said feed box for feeding said second electrolyte against the periphery of said cylindrical rotary body during rotation thereof, said second electrolyte being captured between the periphery of the smaller diameter central portion of said cylindrical rotary body and said metal web, the side edges of said metal web being carried by the peripheral surfaces of the enlarged diameter portions at the axial ends of said body, whereby said second electrolyte is maintained separate from said first electrolyte within said treatment vessel contacting the outer periphery of said metal web.

* * * * *